United States Patent [19]

Zulberti

[11] 4,175,574

[45] Nov. 27, 1979

[54] COSMETICS APPLICATOR DEVICE

[76] Inventor: Carlos A. Zulberti, Ramos Mejia (Prov. de Buenos Aires), Argentina

[21] Appl. No.: 866,165

[22] Filed: Dec. 29, 1977

[30] Foreign Application Priority Data

May 16, 1977 [AR] Argentina ..... 267640

[51] Int. Cl.[2] ..... A45D 40/26

[52] U.S. Cl. ..... 132/88.7

[58] Field of Search ..... 132/88.7, 88.5; 401/121-125, 129, 141, 144, 162; 15/140.3

[56] References Cited

U.S. PATENT DOCUMENTS

| | | | |
|---|---|---|---|
| 2,271,747 | 2/1942 | Conner | 15/140.3 |
| 3,861,810 | 1/1975 | Vasas | 401/122 |
| 3,998,235 | 12/1976 | Kingsford | 132/88.5 |

*Primary Examiner*—G. E. McNeill

*Attorney, Agent, or Firm*—Emory L. Groff, Jr.

[57] ABSTRACT

A cosmetic applicator includes a tank body containing a cosmetic and a removable cap fitted on a sleeve mounted in the upper end of the tank body. A tube is mounted at its upper end in the sleeve, extends into the cosmetic in the tank body and terminates in a tapered, calibrated mouth. A stem carried by the lower surface of the cap, has an applicator at its free tapered end and a collar fixed thereto just above the applicator. An annular resilient disc provided with openings and of greater diameter than the tube is seated in the sleeve and slidable on the stem. The stem is inserted in the tube until the collar abuts the tapered mouth of the tube and in this position, the applicator is immersed in the cosmetic. When the applicator is withdrawn from the cosmetic for use, it passes through the narrowed mouth of the tube so that excess cosmetic is drained from the applicator into the tube body to provide a measured amount of cosmetic on the applicator.

5 Claims, 8 Drawing Figures

COSMETICS APPLICATOR DEVICE

The present invention refers to an improved device for the application of cosmetics or similar products.

Specifically, the said invention deals with an improved device for the application of cosmetics in a liquid or semiliquid state, such as for example tinctures for the eyes, eyebrows, lips and eyelash curlers.

The devices most used at present consist of tubular cases in every respect similar in their outer appearance to fountain pens, comprising a tank body and a cap.

Said cap contains a thin stem to the end of which is affixed the applicator provided with a brush suitable for the type of cosmetic in question.

Both the stem as well as the applicator enter into the tank body and, when being withdrawn, it generally happens that the applicator emerges with an excess of tincture. It also happens that the stem becomes covered with tincture and, when the stem-applicator assembly is reinserted in the tank, the cosmetic being used in the outer part of the tank body usually overflows and the user must be extremely careful not to stain her hands or clothes. The composition of the tinctures, generally fatty, aggravates this inconvenience and the stains are lasting on fingers and fingernails and washing is not always possible when the make-up is applied far from a toilet room.

These problems have in part been solved by means of the present invention which provides means according to which the tincture wets only the applicator, at least when same is being used.

The applicator device through which these effects can be obtained, comprises a tubular case, consisting of a tank body, and a cap to which is integrally and axially affixed at the center thereof a stem terminating in an applicator appropriate for a substantially liquid cosmetic which is contained in said tank body. The mouth of said body is provided with an insert in the form of a sleeve having a coaxial conduit tapering slightly inwards and terminating in a cylindrical portion having a flat, ring-shaped bottom provided with a central bore. This bore opens into a wider mouth directed towards said tank. The said cap, in turn, within the opening thereof, is provided with a cylindrical coaxial body from which said stem projects and terminates in an applicator of the kind called for by the particular cosmetic. This application rests axially against a ring-shaped collar affixed to the said stem, its diameter registering with that of the bore of said sleeve, through which it can pass freely. An annular disc of elastomer material is arranged on said stem and is capable of sliding tightly along same. Its outside diameter is slightly larger than that of the cylindrical portion of the axially tapering conduit of the insert provided in the tank body opening.

The above-indicated device, provides good results concerning the cosmetic being applied exclusively to the small brush at the end of the stem, so that same remains clean and the brush or applicator is always loaded to the same degree when leaving the calibrated orifice which is slightly smaller than that of the brush and thus scraps off the excess cosmetic. However, this arrangement still does not avoid certain functional inconveniences due to the fact that almost all cosmetics contain some fatty base causing same to be more fluid at hot surroundings and harder in cold ambient temperatures. Consequently, it at times happened that the applicator became wetted excessively and other times not.

It has been noticed that the annular disc of elastomer material on the stem acts as a plunger when the device is closed. Consequently, a quantity of air penetrates the tank containing the cosmetic, thus giving rise to two secondary effects.

In one case, the air tends to dry part of the cosmetic contents. In the other case, when the device is uncapped, the air also is extracted by the disc acting as a plunger to charge the applicator with a greater amount of cosmetic than is ideally required.

Consequently, the present invention has for an object to avoid the said plunger effect, the penetration of air, the formation of a vacuum by the brush itself or by the applicator, and the attainment of a perfect closure and exact dosification of the product.

With these objects in view, modifications were made in the annular disc of elastomer material, the applicator bearing stem was provided with a fixed ring-shaped flange or collar, and a guide tube was provided having a tapered end portion through which the applicator was introduced.

The annular disc of elastomer material as improved by the present invention contains four notches or opening which give the disc a shape similar to that of a Maltese cross. As in the known device, the function of this disc is to clean the stem of tincture or cosmetic when same is extracted together with the applicator. Furthermore, the particular shape of the annular disc enables air to escape freely through the notches when the applicator is inserted or withdrawn from the cosmetic containing tank, thus avoiding the plunger effect occurring in the known device.

At the same time, the abutment serving as support for the applicator was removed from the stem and replaced by a fixed ring-shaped flange or collar, close to the end where the cosmetic applicator is located.

The said ring-shaped flange or collar has an outer diameter registering with the inside diameter of the stem guide tube, in such a manner as to permit its free displacement when the applicator is being withdrawn or inserted, the purpose of said ring-shaped flange or collar being to comply with functions such as that of extracting the annular disc of elastomer material from the sleeve when the applicator is taken out from the container tank, permitting the ready passage of air when inserting or extracting said applicator from the container tank through the space separating said flange or collar from the inside wall of the guide tube and, finally, said flange provides a sealing valve for the tapered passage of the guide tube when resting against the inner tapered surface of above mentioned tube.

The guide tube of the applicator bearing stem forming a conduit into which the stem enters axially, is inserted in the bushing part, which is located within the container tank and can have sundry shapes to enable same to act in different manners, as will be explained when referring to the various embodiments described in the present specification.

Another function performed by the guide tube is that of acting as a dosifier for the cosmetic to be incorporated in the applicator when the letter passes through the calibrated-diameter orifice formed by the taper at the free end portion thereof. By varying yhe length of the tapered portion the diameter of said orifice, through which the applicator passes, can be made larger or smaller.

In order to facilitate manufacture, the tube can be interchangeable and consequently, when choosing a tube having an applicator outlet orifice or larger or smaller diameter, an exact and ideal dosification of the cosmetic can be obtained. To this is added that the orifice and applicator combination can be adapted to the different densities of the cosmetic, as likewise to different types of applicators used in practice.

In a variational embodiment of the invention, the tube is mounted in a floating fashion, i.e., capable of a slight axial displacement with the aid of resilient means permitting closure of the mouth situated at the free end thereof by resting same against a ring-shaped flange, provided on the stem and bearing against the tube wall. To this end resilient means can be provided either at the end where the tube engages the bushing or at the free end of the tube in combination with a nozzle.

In a further modification of the device, the guide tube is directly anchored in a bushing or sleeve and its free end is provided with a tapered outlet, i.e., no resilient means are provided to affirm its mouth against the ring-shaped flange of the stem, which simply rests against the tapered inner wall of said mouth, air being evacuated through the notches in said annular disc.

The scope of the present invention, therefore, encompasses an improved device for the application of cosmetics, characterized in that the annular disc, slidably mounted on the applicator stem, is provided with at least three notches in the perimeter thereof and, as from the inner end of the insert arranged in the tank body providing the body of the device, a thin tube is provided, applied by diverse fastening means. The said stem runs axially through said tube and is provided with a ring-shaped flange close to the applicator mounted at the end thereof, the lengths of the assembly being adequately dimensioned in order that said applicator be able to project through the outlet of said tube, said outlet being closed by the aforementioned ring-shaped flange acting as a retainer for the product.

In one variation of the invention, the stem guide tube is firmly anchored in the bushing and, in another variation, it can comprise resilient means permitting a slight displacement of the tube in order to apply its mouth against a ring-shaped collar forming part of the stem and providing a retainer.

According to a further variation of the device, the guide tube is anchored directly in a bushing and the stem is mounted in a floating manner in the cap.

The new elements and aforesaid innovations being put into practice, it was found that same offered highly positive and satisfactory results regarding all the members provided and concerning cleanliness, dosification, high cosmetic yield, etc., its efficiency being increased by the manner of insertion of the applicator assembly in the container tank, the ready expulsion of air between the ring-shaped collar of the stem, the guide tube and the notches of the annular elastomer disc. Furthermore, when the tight closure is formed between the ring-shaped collar of the stem and the tapered end portion of the guide tube, the cosmetic is freed even of traces of air, both in the applicator as well as in the container tank. This assures that the cosmetic to be used maintains its original qualities for a longer period of time, thus extending its useful life.

In order to illustrate the object of this invention more clearly a set of drawings is attached, showing an embodiment which is preferred for explanatory purposes but which in no manner limits the true scope of the invention, as issuing from the annexed claims. Consequently, any type of alterations which do not change the essence of the recital may be introduced.

In said drawings, in which like numerals represent like or similar parts:

Figure 1:
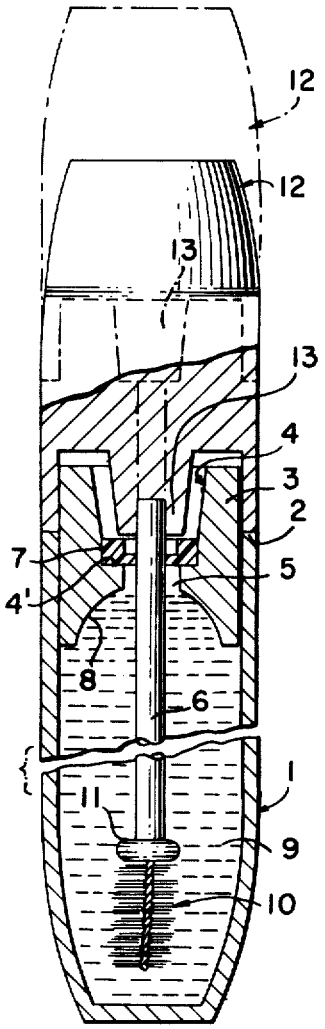
FIG. 1. (PRIOR ART)
FIGS. 1 and 2 are a vertical section of a known applicator device.
Figure 2:
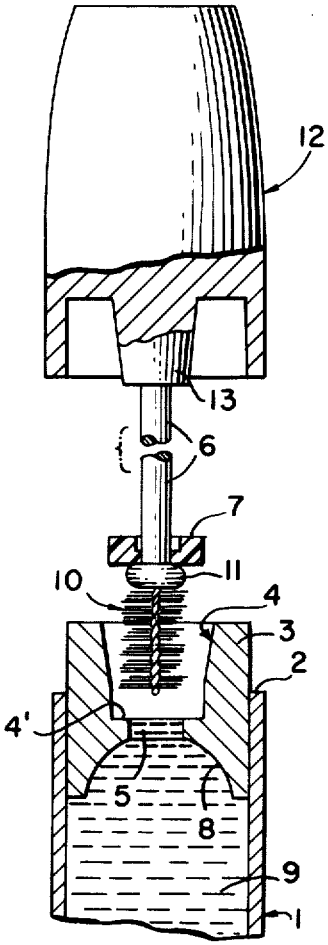
FIG. 2. (PRIOR ART)

As can be seen from FIGS. 1 and 2, the known applicator device comprises a tank body 1 into the mouth 2 of which is inserted a bushing or sleeve 3 limiting an inner conduit 4. This conduit 4 is slightly tapered and terminates in a cylindrical portion defining a seat 4' having an orifice 5 the cross-section of which is circular and the diameter of which is greater than that of a retaining collar 11, the latter forming integral part of stem 6. However, the diameter of said orifice is smaller than that of a disc 7 of elastomer material, slidably mounted on stem 6 and adjusted to said cylindrical portion of conduit 4. Orifice 5 of bushing 3 widens at 8 towards the interior of the cosmetic container 9, receiving an applicator 10 situated beyond collar 11, forming an integral part of stem 6, said stem projecting from a cap 12 tightly lodged against bushing or sleeve 3.

The above-described device functions in the following manner:

When the applicator 10 and stem 6 are inserted through passage 5, disc 7 is retained within tapered conduit 4 until projection 13 of cap 12 is located in the cylindrical portion of conduit 4, against seat 4' the diameter of which is smaller than that of the mouth of tapered conduit 4. This is shown clearly in FIGS. 1 and 2.

In order to use applicator 10, cap 12 is withdrawn, axially displacing stem 6 which, in a state of tight engagement, slides through disc 7, of elastomer material, lodged in seat 4', until retainer collar 11 exerts thrust thereon and permits its withdrawal.

Once stem 6 has come out entirely, it will be found to be perfectly clean inasmuch as the tight engagement of disc 7 in the cylindrical portion of conduit 4 and against seat 4' retains the tincture covering aforesaid stem.

When the applicator 10 is inserted into the tank body 1, a volume of air penetrates the latter. This air tends to dry the cosmetic contained therein and, when said applicator 10 is extracted, same acts as a plunger and is charged with a greater amount of cosmetic than that customarily required.

Figure 3:
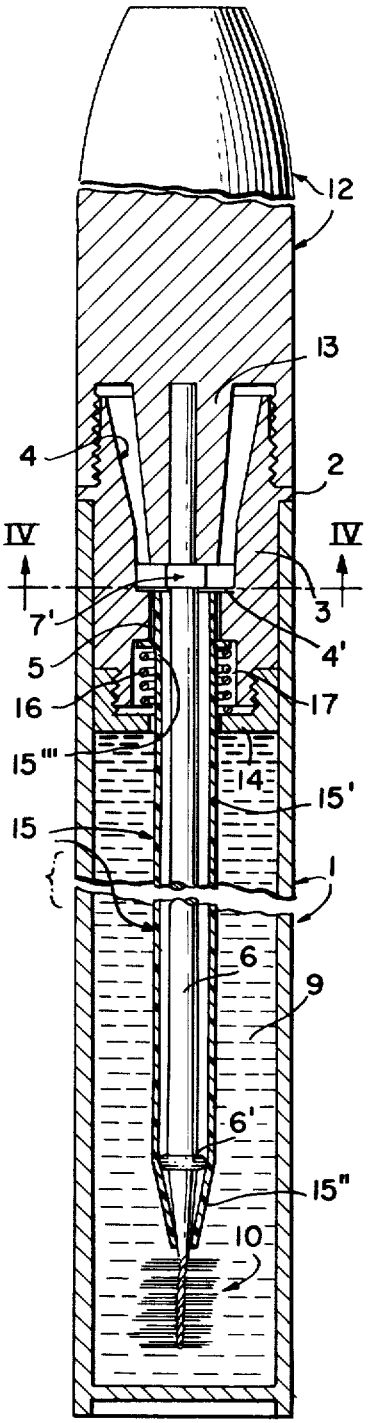
FIG. 3 is a vertical section of a first embodiment of the device according to the present invention.

The improvements which the present invention proposes for the known device, are shown in a first embodiment illustrated in FIG. 3, this Figure showing some of the components included in the device represented in FIGS. 1 and 2. In fact, FIG. 3 shows the cap 12, stem 6 the free end of which is provided with applicator 10 and sleeve 3, provided with a conduit 4, the tapered shape of which is provided with a calibrated passage for an annular disc 7' of elastomer material.

Figure 4:
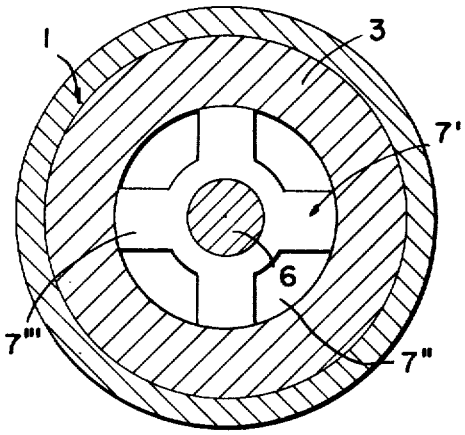
FIG. 4 is a horizontal section along line IV—IV of FIG. 3.

FIGS. 3, and 4 illustrates the particular features of the annular disc 7', the shape of which is similar to that of a Maltese cross, with its opening 7" and projections 7'". The edges of projection 7'" are tightly lodged against the wall of the cylindrical portion of conduit 4, disc 7' resting against seat 4' and, as in the case of FIGS. 1 and 2, being slidably mounted on stem 6.

The openings 7" of disc 7' define an irregular perimeter which, in combination with the wall of cylindrical portion of conduit 4, provides air passages operating during the insertion and extraction of applicator 10, thus avoiding the occurrence of an effect similar to that of a pneumatic piston as in the case of the device represented in FIGS. 1 and 2.

In turn, sleeve 3, at its end located inside container 9, is provided with means retaining the end 15' of a tube 15, projecting from inside container 9, defined by tank body 1. Said retaining means consists of a nut 14 or the like which, in the example of FIG. 3, is threaded into the end of sleeve 3.

Stem 6 slides within tube 15 until the applicator 10, secured to the end of said stem, emerges through the mouth of the free end portion 15" of said tube 15, which is tapered and calibrated in order that, when being extracted from applicator 10, the excess of cosmetic may be drained from applicator 10, towards the interior of container 9. In this manner, the cosmetic is measured exactly.

Tube 15, as explained above, is retained by nut 14 at its end of engagement with sleeve 3. This sleeve 3 is provided with a recess 17, closed by said nut 14 and containing a spring 16 which expands between a ring-shaped flange 15'" on tube 15 and said nut. This can be clearly seen in FIG. 3 of the drawings as permitting the axial displacement of tube 15.

Tube 15 is in this case guided within orifice 5 by a portion thereof extending beyond ring-shaped flange 15'". Consequently, said tube 15 is in a slight measure displaceable during insertion of the applicator, in such a manner that, when the applicator is lodged entirely within container 9, spring 16 biases said tube 15 against the bottom of recess 17 of sleeve 3. This causes collar 6' of stem 6 to bear against the inner surface of the tapered end portion 15" of tube 15, thus closing the outlet of the latter and providing a retainer capable of the preventing the ejection of cosmetic. Collar 6', at the same time, provides an element for pushing and removing disc 7' when withdrawing applicator 10.

Figure 5:
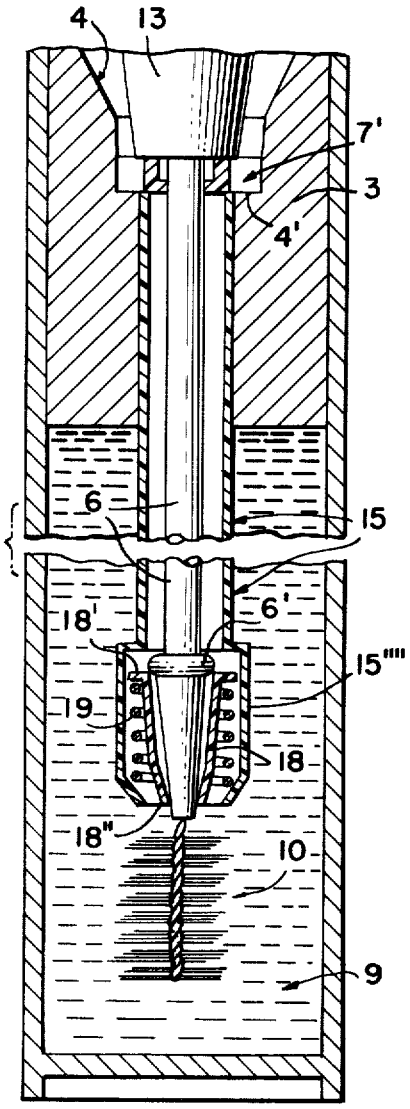
FIG. 5 represents a second embodiment of the device according to the present invention, in a first operative position.
Figure 6:
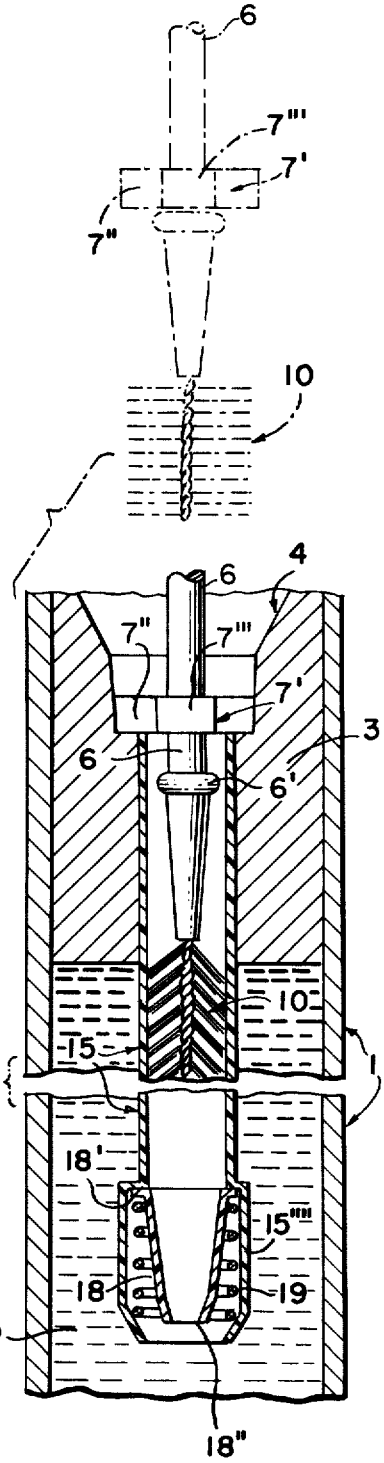
FIG. 6 illustrates the device FIG. 5, in a second operative position.

In a second embodiment, shown in FIGS. 5 and 6, tube 15 is anchored in sleeve 3, i.e., it forms integral part of said sleeve. Its free end, situated in container 9, comprises a coaxial widened part 15'''' designed to house a nozzle 18 which is resiliently biased by a spring 19. This spring is arranged between a flange 18' on nozzle 18 and a lip on widened portion 15''''. The said nozzle 18 is slightly tapered and is coaxially displaceable relative to tube 15 when applicator 10 is inserted into said tube. Nozzle 18 accompanies applicator 10 over a certain stretch, until the latter projects beyond outlet mouth 18" of nozzle 18. Once this has taken place, said nozzle 18 recedes and comes to rest against collar 6' of stem 6 in order to permit the mouth of the nozzle to be closed, thus offering a positive closure which does not permit the cosmetic to be contaminated by air. As in the previous case, said collar 6", permits disc 7' to be extracted when applicator 10 is withdrawn.

The relative displacement of tube 15 or nozzle 18 provided in the embodiments, described in connection with FIGS. 3, 4, 5 and 6, is brought about by applicator 10 and continues until the collar 6', an integral part of stem 6 and located adjacent to the applicator 10, abuts in the first case against the tapered end 15" of tube 15 and, in the second case, against the tapered wall of nozzle 18, thus closing the passage of the cosmetic towards the inside of the tube. At the same time it avoids contamination of the latter by air which may have entered through the said tube.

In both embodiments, the egress of air during insertion of applicator 10 takes place through the passage formed by the inside wall of tube 15 and the collar 6' of stem 6, passing through openings 7" of annular disc 7' and freeing the container of the tank body 1 of the air it may contain.

It should be understood that resilient means 16 and 19, intended to maintain tube 15 and nozzle 18 in a floating manner, can be used indistinctly in the device, with similar results as concerns the closure of the mouth of tube 15.

Figure 7:
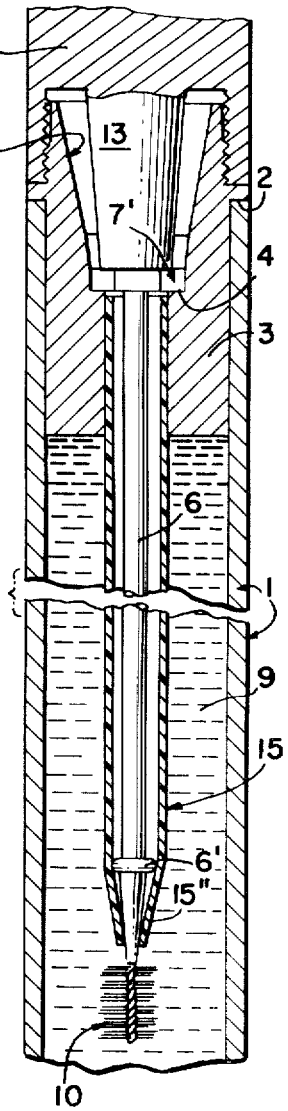
FIG. 7 shows a third embodiment of the device object of the present invention; and finally.

FIG. 7 represents a third embodiment of the present invention. In the embodiment, the device is provided with a tube 15 guiding stem 6. This tube is secured by pressure to the end of bushing 3 in order to avoid axial displacements such as those occuring in the devices illustrated in FIG. 3.

In said embodiment, the free end of tube 15 is conical and is not provided with said nozzle 18. The collar 6' with which stem 6 is provided, permits the venting of air during the introduction of applicator 10 and, at the same time, provides an element for closing and extracting disc 7' and for sealing the end cone 15" of aforesaid tube 15.

Figure 8:
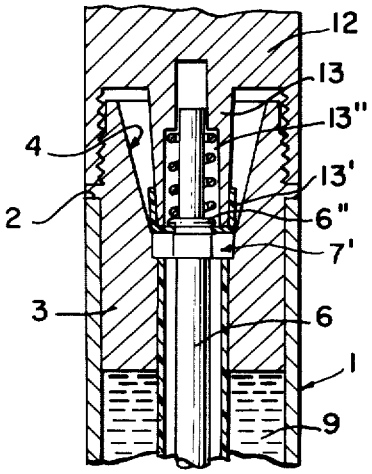
FIG. 8 shows a fourth embodiment of the device object of the present invention.

FIG. 8 illustrates a fourth embodiment of the device which is the object of the present invention. In this embodiment, the guide tube 15 of stem 6 is affixed to the end of sleeve 3. Said stem 6 carries an annular disc of elastomer material 7', floatingly mounted in extension 13 of cap 12.

For this purpose, the end of stem 6 is provided with a second collar 6" retained by a cup 13' in a recess 13" of extension 13 of cap 12, said collar 6" being biased by a coaxial spring as regards a part of stem 6, bearing against the bottom of recess 13".

This floating arrangement of stem 6 also permits the axial displacement directed to close the tapered portion 15" by means of collar 6'.

I claim:

1. An improved device for the application of cosmetics of the type comprising, a tank body having an open mouth, a sleeve fitted in said mouth and having a conduit which is coaxial and slightly tapering towards the inside of the tank body until terminating in a cylindrical portion having a flat annular seat, said conduit provided with a central bore followed by a widened portion the broader part of which is oriented towards said tank body a cap having within its opening a coaxial cylindrical body, a stem projecting from the center of said coaxial cylindrical body, an applicator at the end of said stem, a collar affixed to said stem, the outside diameter of said collar registering with the diameter of the bore of said sleeve and being able to pass freely therethrough, said stem being provided with an annular disc of elastomer material which is capable of sliding in tight engagement along said stem and the outside diameter of which is slightly larger than the inner diameter of the coaxially tapered conduit of the sleeve inserted into the mouth of the tank body, wherein said annular disc slidingly mounted on said stem has at least three openings which at spaced points interrupt the cylindrical continuity of the perimeter of said disc, a tube projecting axially from the inner end of said sleeve and which receives said stem and its applicator, the lengths of the tube and stem being dimensioned in such a manner that only said applicator is immersed in the cosmetic contained in said tank body in a location immediately adjacent to a tapered, calibrated diameter mouth provided in the free end of said tube, a collar on said stem, said collar located adjacent to said applicator, said collar having a diameter which is slightly smaller that the inside diameter of said tube in order to define therewith an air-venting passage while the applicator is being inserted.

2. A device, in accordance with claim 1, wherein said tube floatingly engages said sleeve, said sleeve having a recess closed by a nut through which the said tube projects towards the inside of the container, the portion of the tube located in said recess having a ring-shaped flange of larger diameter than the opening of said nut, there being arranged between the said flange and the said nut a small expansion spring capable of biasing said flange against the bottom of the said recess, the said tube extending towards the inside of the sleeve to provide a guide means therefor, that end of the tube which is located inside the tank body being in turn provided with a tapered mouth capable of being closed by said collar on said stem.

3. A device in accordance with claim 1, wherein said tube is anchored in said sleeve and, at its free end located inside the container, is provided with a coaxial widened portion which, in a freely slidable manner, houses a nozzle provided at the lower edge thereof with a flange supporting an expansion spring the opposite end of which, in turn, bears against a lip of said widened portion, said nozzle being slightly conical in shape and being capable of displacement during insertion of the applicator and said nozzle, once the applicator has been introduced, said nozzle remaining in supporting relation against the collar of said stem, thus providing a means of closure and retainment of the cosmetic.

4. An improved device for the application of cosmetics, of the type comprising a tank body having an open mouth, a sleeve fitted in said mouth and having a coaxial conduit tapering slightly towards the inside of the tank body and terminating in a flat annular seat having a central bore followed by a widened portion the broader part of which is oriented towards said tank body, a cap having an opening, a coaxial central body within said opening, a stem projecting from the center of said central body, said stem including a collar adjacent to its end, an applicator mounted on the end of said stem, the outside diameter of said collar registering with the diameter of the bore of said sleeve and being able to pass freely therethrough, an annular disc of elastomer material mounted on said stem, said disc being capable of sliding in tight engagement along said stem and having an outside diameter which is slightly larger than the inner diameter of said tapered conduit of said sleeve, wherein said annular disc slidably mounted on said stem is provided with at least three openings at spaced points which interrupt the cylindrical continuity of the disc perimeter, a tube projecting axially from the inside end of said sleeve inside the tank body, said stem and applicator being freely displaceable within said tube, the lengths of the tube and stem being dimensioned in such a manner that said applicator is immersed in the cosmetic contained inside the tank and body and is located adjacent to the calibrated diameter mouth of said tube, a collar on said stem, adjacent to said applicator, said collar being of a diameter slightly smaller than the diameter of said tube, said collar, during extraction of said applicator, being capable of permitting the passage of air towards the outside, through the tube and openings in said disc, said collar providing a closure means for said tube and means for pushing and removing the disc which controls the passage of air and permits the cleansing of the stem.

5. A device, in accordance with claim 4, wherein said stem is secured in a floating manner to said cap due to biasing by a coaxial spring on an extension thereof housed in a recess provided in a projection of said cap.

* * * * *